United States Patent [19]

Frankle et al.

[11] 4,066,137

[45] Jan. 3, 1978

[54] FLAME JET TOOL FOR DRILLING CROSS-HOLES

[75] Inventors: Helmut Frankle; Werner Baum, both of Canoga Park, Calif.

[73] Assignee: PEI, Inc., Malibu, Calif.

[21] Appl. No.: 694,902

[22] Filed: June 10, 1976

[51] Int. Cl.[2] ..... E21B 7/14

[52] U.S. Cl. ..... 175/14; 175/51; 175/77

[58] Field of Search ..... 175/11-16, 175/61, 51, 78, 97-99, 67, 77

[56] References Cited

U.S. PATENT DOCUMENTS

| | | | |
|---|---|---|---|
| 2,327,023 | 8/1943 | Danner | 175/51 |
| 2,516,421 | 7/1950 | Robertson | 175/98 X |
| 2,539,047 | 1/1951 | Arutunoff | 175/78 X |
| 3,045,766 | 7/1962 | Fleming, Jr. | 175/15 X |
| 3,152,651 | 10/1964 | Ross | 175/11 |
| 3,797,576 | 3/1974 | Azalbert | 175/61 |

*Primary Examiner*—Ernest R. Purser
*Assistant Examiner*—Richard E. Favreau
*Attorney, Agent, or Firm*—Richard H. Zaitlen

[57] ABSTRACT

A flame jet lance having a rotatable drill bit for forming cross holes in the ground is disclosed. The lance has various fuel and oxidizer tanks disposed therein and a fuel feed system coupled to the tanks for pumping the fuel to the rotatable drill bit. An extension member is also disposed in the lance with one end thereof coupled to the feed system and with the rotatable drill bit coupled at the other end thereof. The extension member is movable in the lance such that as the drill bit burns its way through the earth, the extension member moves the bit outward to a position lateral from the lance. In this manner, oil, gas, and the like may travel through the cross hole thus formed into the initial well hole.

In operating the flame jet lance of the present invention, the lance is lowered into the preexisting well hole a specific distance. The flame jet drill bit is ignited and extremely hot flames are forced out through a nozzle contained in the drill bit. Because the extension member is adapted to move the drill bit laterally with respect to the lance, cross holes are created orthogonal to the initial well hole in the ground. This permits oil, gas and the like which had previously been unable to be pumped out of the surface from the original well hole, to now flow into the original hole and thus be rendered removable. By the use of the flame jet lance of the present invention, improvements in oil and gas recovery are achieved.

25 Claims, 8 Drawing Figures

Fig. 3
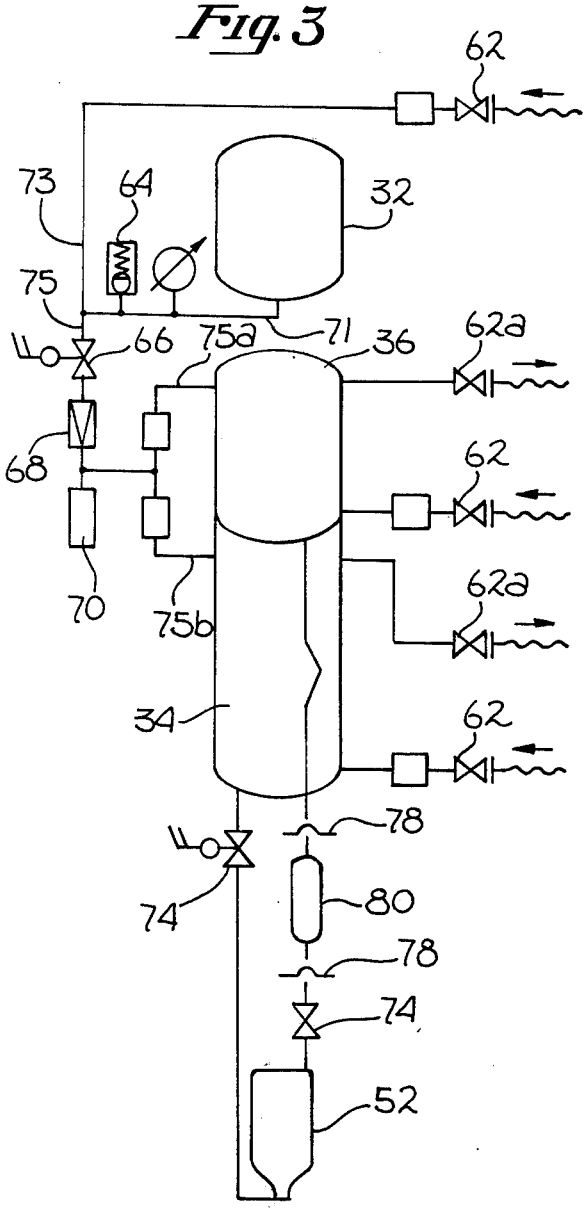
Fig. 4
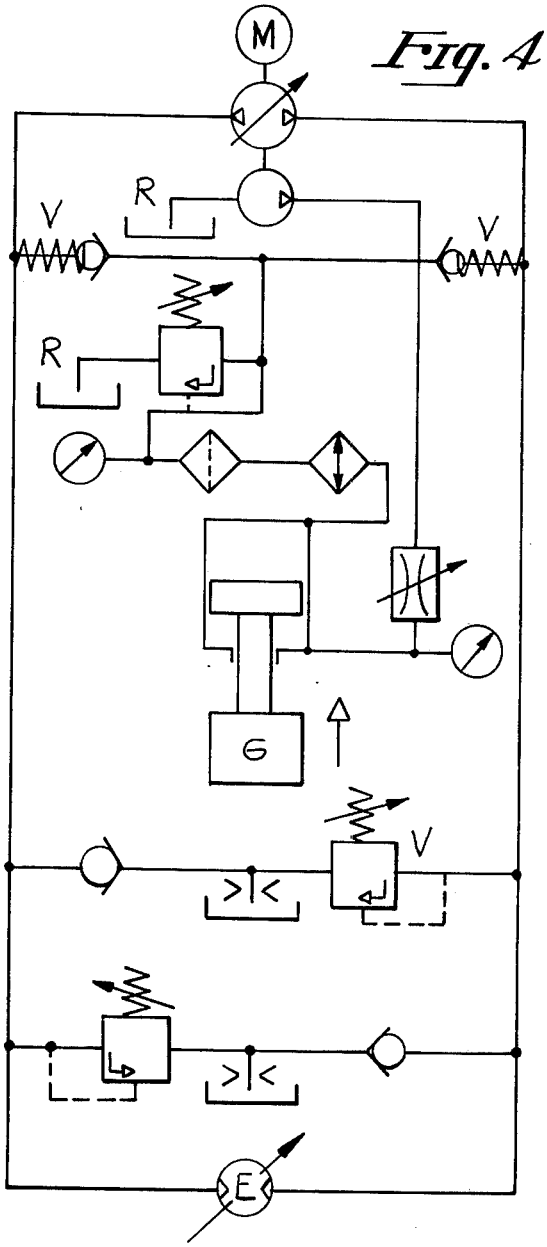
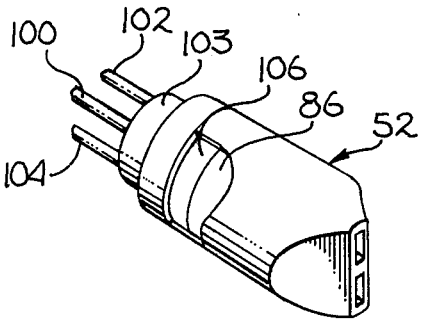
Fig. 5
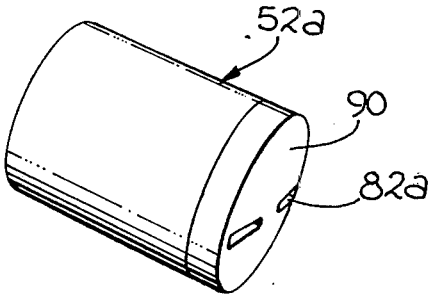
Fig. 6

FLAME JET TOOL FOR DRILLING CROSS-HOLES

BACKGROUND OF THE INVENTION

1. Field of the Invention

The present invention relates to the field of oil well drilling means, and more specifically, to a flame jet lance for drilling cross holes.

2. Prior Art

Excavation means and specifically excavation means utilizing a nozzle type of instrument are well known in the art. One such system is disclosed by Ross, U.S. Pat. No. 3,152,651. In the Ross apparatus, an elongated member is lowered into the ground whereupon a steam jet nozzle is activated. Activation of the nozzle causes the steam to act upon the ground in such a manner that chunks of material are gorged out of the ground. The pressure from the steam jet nozzle also sends these chunks crashing about to further strike and break up the surface adjacent the jet nozzle. It should be noted, hwever, that such device, while perhaps useful for forming perpendicular holes in the ground, cannot be used for making cross holes, i.e. holes generally orthogonal with respect to the well hole. Moreover, while such a steam jet nozzle may be able to work under certain soil conditions, many types of hard, solid rock are not easily broken up by such a system.

Another type of device is disclosed by Kariovitz, U.S. Pat. No. 3,122,212. In the Kariovitz device, a combustible material is fed into a burner where it is ignited and hot gasses are ejected adjacent the ground. These gases, more in the form of explosions, break up the layers of the ground into chips which are carried by the blast to the surface. Such devices, while perhaps useful for certain types of rock, may not prove to be useful where chip-like particles are not formed. Moreover, there is no indication that such device can be used to form cross holes.

Yet another type of device is disclosed by Fleming, U.S. Pat. No. 3,045,766. In the Fleming device, a blow pipe is lowered into the earth which contains a rotating burner adjacent the bottom thereof. Fuel and oxygen are supplied to the burner and the flames emanating therefrom are used to melt holes in the ground. While such a system has proved to be useful in a wide range of different type of soil and rock, as with the other prior art devices discussed hereinabove, there is no indication that such device can be used to form cross holes in the earth.

The prior art devices, including those discussed hereinabove, all use a variety of fuels, such as, for example, steam, super heated water, or flames which form the cutting means by which holes are created in the ground. Of the shortcomings associated with these devices, the most significant is the fact that such devices can only be used to create holes in a direction which is perpendicular to the surface of the earth. In the exploration of oil, it has been found that additional holes are also necessary in order to help the oil drain from the areas adjacent the initial oil well hole. The need to recover the oil from areas adjacent the initial hole has caused significant problems in that it has required the drilling of a number of perpendiclar holes in the same location to increase drainage. This is both expensive and time consuming. The present invention enables lateral holes to be formed adjacent the initial hole whereby oil and the like can drain into the well hole and be easily removed therefrom. Thus, while it is well known in the art that various means have been used to create holes in the ground, and while it was also known that if holes could be drilled lateral to the original hole, more oil would exude into the original hole, the art has never found an effective solution thereto until Applicant's novel apparatus.

BRIEF SUMMARY OF THE INVENTION

The present invention relates to a novel means for creating cross holes in the earth, and more specifically, to a self-contained, readily complete flame jet lance having an extendable drill bit adjacent the top thereof. In the present invention, the lance lends itself to incorporation with an entire system whereby cross holes can quickly and easily be formed in an initial well hole without even the need for refueling the flame jet lance once it has expended itself. More specifically, a truck or other heavy equipment can be used to lower the flame jet lance into the original oil well hole. Spare lances can be mounted on a truck enabling a quick exchange upon exhaustion of the fuel in the original lance. The lance of the present invention comprises a self-contained fuel system for storing and mixing the chemical reactants, and a novel flame jet drill bit. The drill bit has a retracted position and an extended position, and contains a reaction chamber and a rotatable nozzle. In its retracted position, the drill bit is disposed within the lance adjacent the top thereof. This enables the lance to be easily raised and lowered in the well hole. A novel extension member is coupled to the fuel system and to the drill bit, and selectively moves the drill bit from the interior of the lance to the exterior thereof at a predetermined rate. This is achieved by a driving means which is coupled to the extension member such that activation of the driving means moves the drill bit from its retracted position in the lance to its extended position lateral to the lance. As the drill bit is being extended, flames are emitting from the drill bit and are causing the earth to melt and crack so as to form holes lateral with respect to the well hole in which the lance has been lowered. When the fuel is spent, the drill bit is retracted into the lance and the lance raised to the surface where a second lance is then lowered into the ground to either drill a second cross hole or further extend the initial one which has been formed.

The novel features which are believed to be characteristic of the invention, both as to its organization and methods of operation, together with further objectives and advantages thereof, will be better understood from the following description considered in connection with the accompanying drawings in which a presently preferred embodiment of the invention is illustrated by way of example. It is to be expressly understood, however, that the drawings are for the purpose of illustration and description only, and are not intended as a definition of the limits of the invention.

BRIEF DESCRIPTION OF THE DRAWINGS

FIG. 3 is a schematic drawing showing the various fuel and oxidizer tanks and pumping valve configurations.

FIG. 4 is a schematic view of an hydraulic unit used to pump the various reactants from the lance to the reaction chamber in the drill bit.

FIG. 5 is a cutaway perspective view showing a first type of drill bit.

FIG. 6 is a perspective view showing a second type of drill bit having a substantially flat head.

DETAILED DESCRIPTION OF THE INVENTION

Figure 1:
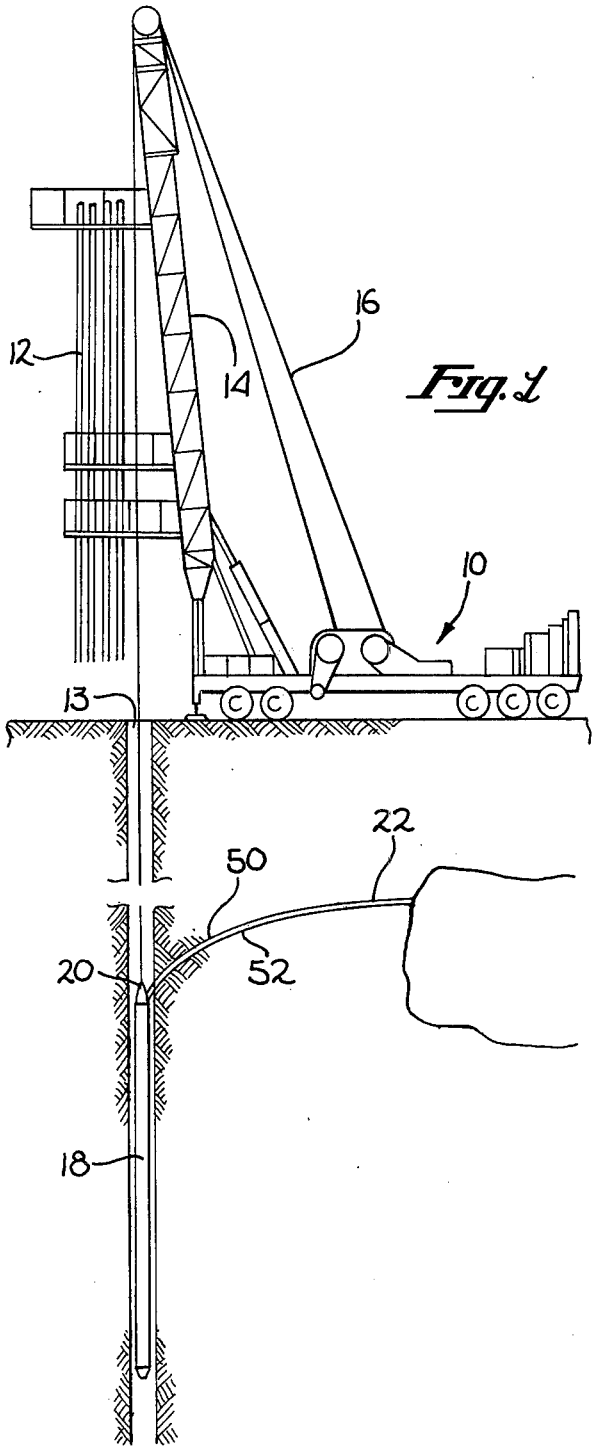
FIG. 1 is a schematic view showing the flame jet lance being lowered from a mobile rotary drill rig.

Referring first to FIG. 1, there as shown, as a presently preferred embodiment, a mobile rig unit 10 which is used for raising and lowering the flame jet drilling lance 18. The mobile rig 10 has a boom 14 disposed at one end thereof and a cable system 16 for raising and lowering the lance 18. Such cable system 16 for raising and lowering the lance 18 are well known in the art and the specific operation of the boom 14 and cable system 16 will not be explained in detail herein. The mobil rig 10 also has a number of extra lances 12 which enables a quick change of the lances to take place after the fuel has been expended from the originally lowered lance. Such a rig and cable system enables cross holes indicated by numeral 22 to be quickly formed in the well hole 13 without the need for spending long periods of time refilling the original lance. Such system, therefore, can make a plurality of such cross holes 22 in a relatively short period of time.

The cable 16 is coupled to lance 18 via coupling 20. Coupling 20 insures that undesirable rotation of the lance 18 will not take place and also insures a secure interconnection between the cable 16 and the lance 18. While FIG. 1 indicates that a truck-type mobile boom rig is used to lower the lance 18 into the hole 13, other systems such as a stationary-type system are also within the scope of the invention.

Figure 2:
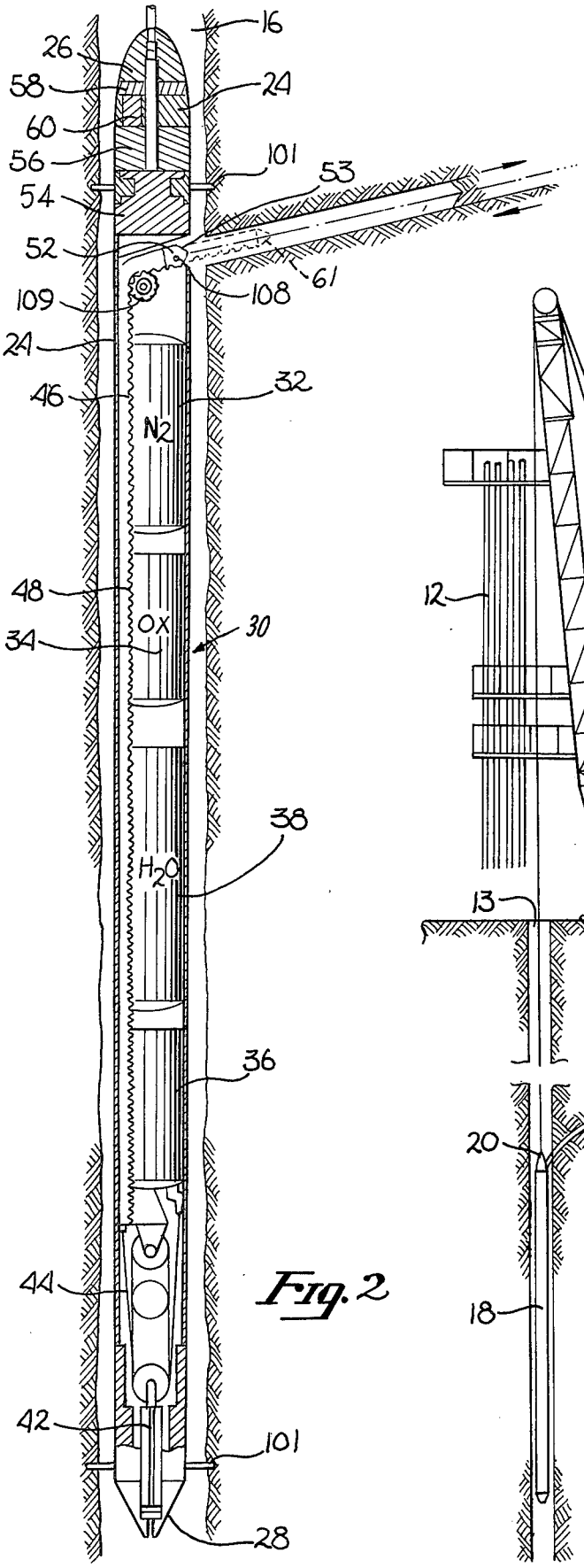
FIG. 2 is a cutaway view of the lance showing the elements thereof including the link members which are coupled together forming the extension member which is used to extend the drill bits from the lance.

Referring now to FIG. 2, a cutaway view of the flame jet lance 18 is shown disposed in a typical well hole 13. The lance is comprised of a hollow steel sheath 24 forming a tube-like member and has a first end 26 and a second end 28. Disposed within lance 18 is a fuel feed system generally referred to by the numeral 30. In the presently preferred embodiment, fuel feed system 30 comprises a nitrogen feed tank 32, an oxidizer feed tank 34, and fuel tank 36. A water tank 38 is also disposed within the lance 18 for use in the drill bit as hereinafter described. The fuel system 30 is self-contained and can stand high temperatures and pressures. The tanks are disposed one atop the other such that minimal diameter of the lance 18 is achieved. Such feed systems are well known in the art and use pump or pressure means to move the reactants from their initial tanks to a desired location. In the presently preferred embodiment, feed system 30 includes flexible tubing 44 which is used to carry the reactants from the feed system 30, through the extension member 48 to the drill bit 52. Such feed systems are well known in the art and are adapted to be used with liquid fuels such as liquid oxygen, liquid nitrogen, kerosene, nitric acid, diesel oil and the like. Also disposed adjacent the bottom 28 of the lance 18, is a hydraulic system 42 which for the purpose of moving up and down the flexible feeding tubes 44 on a pulley configuration. While such hydraulic systems are well known in the art, they must be adapted to be able to work at various temperatures and pressures. The hydraulic system 42 and associated pulleys keep a constant tension on tubing 44 such that a constant feed is achieved.

Configured within the lance 18 is a channel 46 which may be preferably located adjacent the interior wall thereof. Channel 46 enables the elongated extension member 48 to pass from a position adjacent the bottom of the lance 18 to the top thereof. Extension member 48 is comprised of a series of interconnected link members 50 and is coupled to the feed system 30 at one end thereof and to the drill bit 52 at the other end thereof.

Drill bit 52 is located near the top or first end 26 of the lance 18 in opening 53. Also located at this end of the lance 18 is a sequencer 54 which regulates and controls the rate at which the drill bit 52 is extended out of the lance 18, by controlling and activating the feed system 30 and toothed wheel 108. A battery 56 is also disposed in the lance 18 used to power the sequencer 54, as well as other aspects of the invention. A feed back system 58 is located in end 26 to determine the rate at which the drill bit 52 is proceeding through the rock and to feed this information to other components, such as the sequencer 54 as well as a locking device 60 used to selectively lock each of the link members 50 together as hereinafter described. In the presently preferred embodiment, sequencer 54 and feedback system 58 is also coupled to a toothed wheel 108 and activates the wheel 108 which causes it to rotate with a controlled pressure about its axis. As each of the teeth 109 engage an associated link member 50, it forces the member 50 in the upward direction thereby causing the entire extension member 48 to proceed upward from the lance 18. Thus, while the toothed wheel 108 pushes the extension member 48 out of lance 18. The hydraulic system 42 adjusts the length of tubing 44 so as to take up any slack. Of course, other systems are also available within the scope of this invention. The specific operation of the toothed wheel 108, as well as the locking device 60 will be described in more detail hereinafter.

FIG. 2 also indicates, as shown in phantom line 61, that the extension member 48 and the drill bit 52 are extended laterally with respect to the lance 18 and form cross holes 22 having a generally perpendicular configuration with respect to the originally formed well hole 13.

Referring now to FIG. 3, a diagrammatic indication of the whole feed system is shown. The nitrogen tank 32, in the presently perferred embodiment, can hold approximately 110 liters and is capable of withstanding 170 bar pressure. The fuel tank 36 holds about 30 liters and can stand approximately 30 bar pressure. The oxidizer tank 34 can hold approximately 190 liters and can withstand a pressure of 30 bar. The nitrogen tank 32 has coupled thereto a release valve 64 which valve permits excess pressure built up to be released, thus reducing the chances of a bursting due to an unnatural increase in pressure. The release valve 64 is coupled to nitrogen tank 32 along line 71. Line 71 divides into lines 73 and 75 with line 73 being coupled to a fill valve and quick connection system 62. System 62 permits the nitrogen tank 32 to be quickly and easily filled from a source exterior to the lance 18. Line 75 is coupled to start valve 66 which has a pressure regulator 68 and associated release valve 70 coupled thereto. Release valve 70 further acts as a safety valve to relieve the system should it experience an unnatural increase in pressure.

Fuel tank 36 also has a fill valve and quick connection system 62 to enable the lance 18 to be quickly refilled at the ground surface. When filling the fuel tank 38, it is preferred that both an inlet and outlet are provided. Thus, a second fill valve system 62A acting as the outlet means is also provided. Such inlet and outlet system, in the present preferred embodiment, is also used on the oxidizer tank 34.

The nitrogen tank 32 is coupled to both the fuel tank 36 and to the oxidizer tank 34 via lines 75A and 75B, and is used to force both the fuel and the oxidizer from their respective tanks through associated lines and into the flame jet drill bit 52 where it is combusted. It is to be understood that other inert gases may also be used, or that pumps can be used to force the fuels into the drill bit 52. The oxidizer passes out of tank 34 through propellant valve 74, while the fuel passes out of tank 36 through, in the presently preferred embodiment, a furfuryl alcohol (igniter) tank 80 and a second propellant valve 74. Burst membranes 78 are also disposed on the line through which the fuel passes to separate the furfuryl from the other reactants prior to mixture in the drill bit 52 so as to permit the drill bit to be easily and safely transported. Furfuryl alcohol is used as the igniter in the present embodiment because the oxidizer and fuel are non-hypergolic, i.e. they will not ignite spontaneously. In this manner, the oxidizer fuel, and igniter due to nitrogen pressure, are forced through their respective lines to the flame jet drill bit 52 where for the first time the furfuryl alcohol is permitted to contact the fuel and oxidizer initiating the reaction. While the present system is based on the use of nitric acid/diesel oil reactants, it requires two tanks along with a minor tank of furfuryl alcohol, which causes the initial reaction to easily take place. It is understood that the number of tanks and the specific components of each tank depend on the specific reactants desired and, for example, if the fuel used is hypergolic, there is no need for the igniter tank 80 and related burst membranes 78. Moreover, while not indicated in FIG. 3, in the preferred embodiment, water tank 36 is provided which water is ultimately pumped through to the drill bit 52 and is used to cool the exhaust nozzles 82 of drill bit 52.

Referring now to FIG. 4, the hydraulic system of the present invention is clearly indicated. While such hydraulic system does not form a specific novel aspect of the present invention, a schematic is provided so as to indicate one working example of a typical hydraulic system. In the preferred embodiment, the motor M is a one kilowatt dc motor and produces a pressure of 250 bar. The weight G is the tension of the flexibles and exerts a force of up to 200 N. Various reserves R are provided as well as valves V. Finally, the rotatable element E is rotatable. In this manner the hydraulic cylinder 42 get the right tension on the tubing 44.

Referring now to FIGS. 5 and 6, the preferred flame jet drill bits 52 are indicated. In one embodiment, the drill bit 52 has a rather conical shape forming a nozzle 82 having two outlets. Such nozzle section 82 is rendered rotatable around bearing 86. The rotation is caused by motor 106 which is preferably an electric motor although other motors, such as hydraulic and the like may also be used. In the preferred embodiment, the nozzle 82 rotates at approximately 50 to 60 revolutions per minute. The drill bit 52 is coupled at rotating flow through 103 to the links 50 as hereinafter described. Running through the chain links and the rotating flow through and into the drill bit 52 are the various reactant lines 100 and 102, as well as the power lines 104 used to drive the necessary motor 106.

FIG. 6 shows a different configuration for a similar drill bit which would also rotate about a bearing member and have a rotation motor to cause the rotation of the flat face member 90. In the second embodiment, the slits or nozzle openings 82*a* are disposed on the flat face 90 which also rotates at approximately 50–60 rpms. In one embodiment of the present invention, water is supplied through one of the slits such that the rock is simultaneously subjected to a high temperature flame jet as well as water. The combination of the hot and cold causes spalling of the rocks, dirt and the like, thus increasing the speed at which the drill bit 52 can proceed through such materials.

Figure 7:
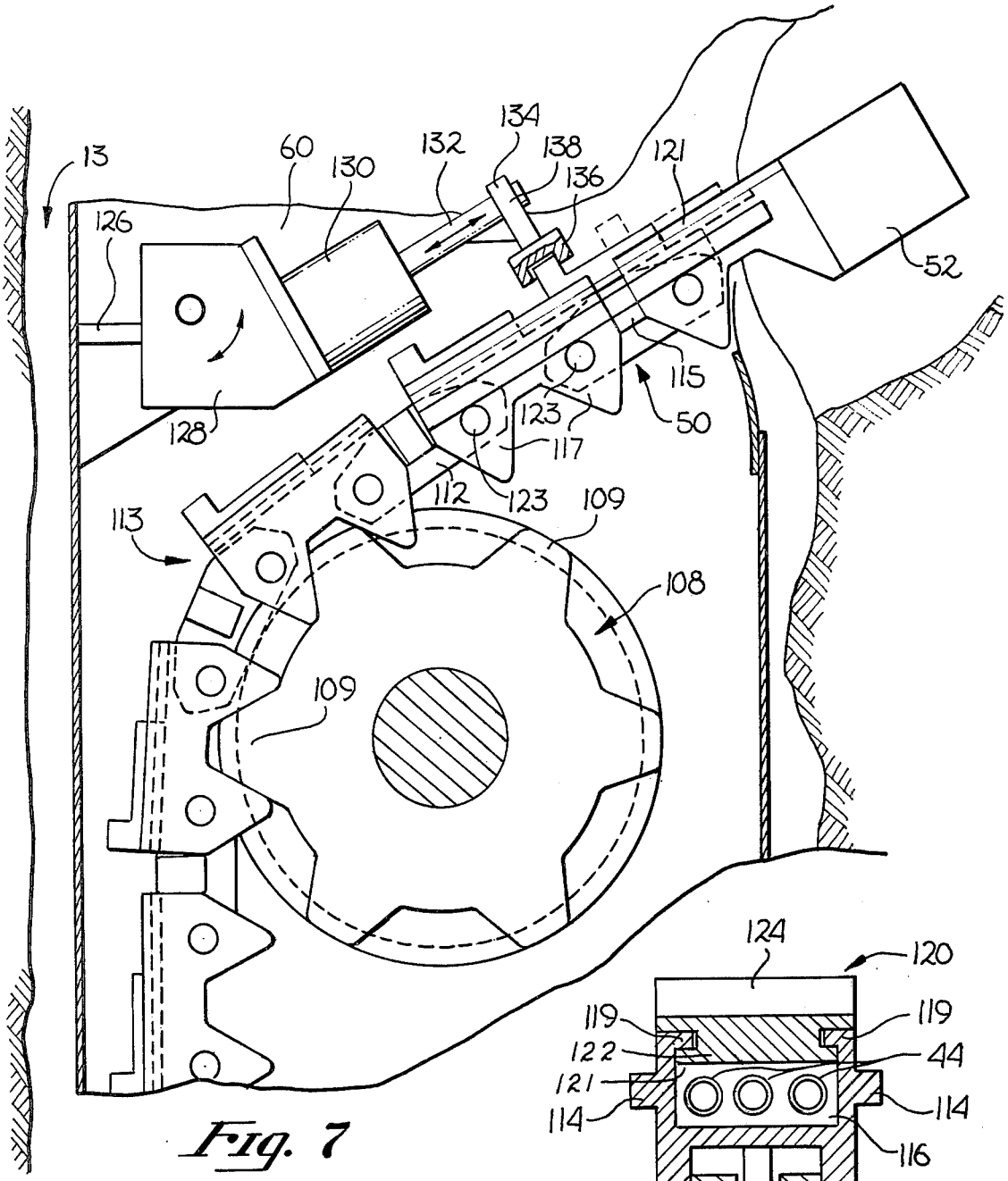
FIG. 7 is a front view showing the specific link system and how it is advanced out of the lance.
Figure 8:
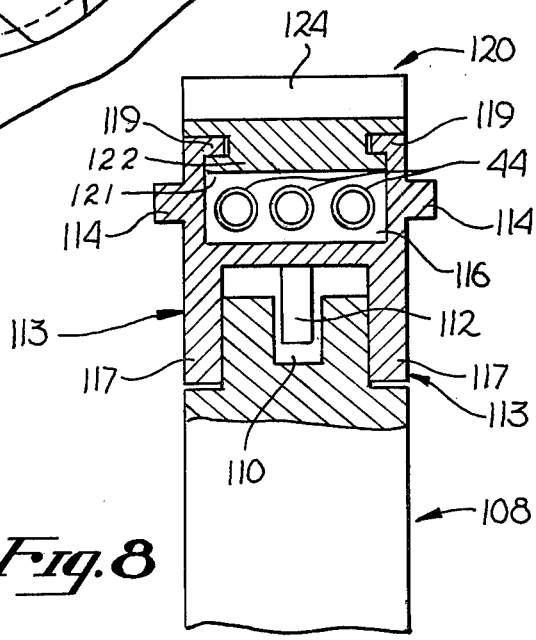
FIG. 8 is a cross-sectional view showing the coupling latch and an associated link member.

Referring now to FIGS. 7 and 8, the specific means by which each of the link members 50 are coupled together as they proceed out of the lance 18 will now be described. Referring specifically to FIG. 7, there shown, as the presently preferred embodiment for activating such interconnection amongst adjacent link members 50, a locking device 60 coupled to the lance 18 via support members 126. Base member 128 supports a motor 130 of the locking devices 60 which is adapted to cause the rotation of a movable arm member 132. Motor 130 is also adapted to extend and retract arm member 132 as hereinafter described.

Adjacent the end 134 of the arm 132 is an outwardly extending arm member 138, and at the end of arm member 138 is an associated slotted engaging member 136. Slotted member 136 is arranged and configured so as to selectively engage a latch member 120 slidably disposed in an associated link member 50. Also shown in FIG. 7 is the fact that each of the link members 50 has two tooth-like segments 117 on each side thereof in a parallel and spaced apart configuration. Between each adjoining link 50 is a joint member 115. While joint member 115 couples two adjacent links together, such joint member permits the links to be rendered substantially flexible such that they can twist around the toothed wheel 108. This permits the entire extension member 48 to be rendered sufficiently flexible so as to be storable inside of the lance 18 yet, when activated, be extendable to a position lateral to the lance 18. Such joints 115 achieve the desired flexibility by being coupled to each adjacent link 50 by a flexible spring or other flexible metal member.

Disposed between the teeth 117 is the slidable latch 120. Latch 120 is comprised of a head member 124 and a tab member 122. Tab member 122 is slidably disposed in area 121 located adjacent to the periphery of an associated link 50. Inwardly extending ledge members 119 (see FIG. 8) prevent tab 122, and thus latch 120, from detachment from an associated link 50.

Referring now to FIGS. 7 and 8, one can see the latch 120 has the aforementioned outwardly extending head member 124 and tab member 122 which is slidably engaged in an associated link 50. As the latch is side across to the adjacent link 50, the tab member 122 is engaged by each of the inwardly extending ledge members 119 disposed on the adjacent links. With the latch 120 in this position, the two adjacent chain links are rendered substantially inflexible, thus creating a rigid member supporting the drill bit 52 and providing a substantially straight path for the reactants, water and the like, as well as the power lines to the drill bit 52.

Also shown in FIG. 8 is the fact that, in the preferred embodiment, each link 50 has a guide member 112 disposed thereinbetween so as to form a pathway along the length of the member 48. The guide member 112 is engaged by the toothed wheel 108 and more specifically by an associated slot 110 in the wheel 108 so as to prevent undesirable movement of each link 50 of the extension member 48 as it proceeds out of the lance 18. Guide members 114 are also disposed adjacent the sides of each of the links which are engaged by a rail system (not shown) to further aid in guiding the extension member 48 out of the lance 18. A cavity 116 is located in the center of each link 50 and forms a continuous chamber from one end of the extension member 90 to the other end such that flexible tubing 44 proceeds from the bottom of the lance 18 (see FIG. 2) up through all the links and into the drill bit 52. (see FIG. 5).

In operating the system of the present invention, it should be remembered that cable tool rigs currently from holes to depths of approximatey 2000 meters. Because the flame jet lance 18 of the present invention is completely self contained, these depths can be easily surpassed. Moreover, the removal of debris is effectuated by the combustion gases expended from the drill bit 52, and more particularly, from the nozzles 82, which, at an estimated velocity of 100 meters per second, creates considerable flushing force, thus causing debris to be forced out to the surface. The flame jet drilling lance 18 of the present invention has found to be best suited for the following materials:

Quartzite, dollomite, granite, sandstone, iron pyrite, rhyolite, syolite, syonite, hemotite, doconoite, basalt, and other similar materials.

The flame jet drill lance 18 can be fueled preferably on the drilling rig 10 from an exterior source via valve system 62 so that the lance can be replaced and/or refueled without any lengthy delay. Refuelling is done from associated tank trucks, each each mounted with a fuelling unit through the leak-proof, quickfilling connections 62. While the lance is being lowered via cable 16, the gas pressurization system is sealed off by NC shut-off valves. During this phase, there is no pressure in in the propellant tanks. The lance is ignited by activating the pressure system and opening the engine valves and is initiated by the sequencer 54. The propellants are driven to the combustion chamber in the drill bit 52 by pressurized gas (nitrogen is the preferred pressurized gas but other gases or a pumping system are of course within the scope of this invention). The propellants are first ignited by the preliminary reaction of the furfuryl alcohol, and is entirely expended in six minutes at a combustion chamber pressure of 14 bar. The following represents typical flame jet drilling performance characteristics:

| | |
|---|---|
| Thermal output per second | 5560 kJ/s |
| Mechanical output of the exhaust stream on jet nozzle | 515 kJ/s |
| Mechanical output in rock | ca. 1400 kJ/s |
| Mixture ratio $= \frac{\dot{m}\ HNO_3}{\dot{m}\ \text{diesel oil}}$ | $= 5.54$ |
| Specific propellant consumption (granite) | $m_g = 2.38\ g/cm^3$ |
| Propellant consumption | $\dot{m} = 0.950\ kg/s$ |
| Propellant volumes | $V_p = 0.17\ l/s$, $V_{ox} = 0.52\ l/s$ } $V_g = 0.69\ l/s$ |
| Lance's burning time | t = 6–30 minutes depending upon amount of fuel and rate of consumption. |
| Rate of drilling (maximal): | |
| sandstone | 92 m/hr. |
| granite | 21 m/hr. |
| basalt | 18 m/hr. |
| bore diameter | variable |

In operating the flame jet lance 10 of the present invention, the tanks within the lance are filled with the desired reactants and driving gas to force the reactants through the system. The cable 16 is attached to the coupling 20 on the lance 18 and the mobil rig 10 beings to lower the lance 18 down into the well hole 13. At a specific distance down into the hole, which can be determined by measuring the length of cable 16 which enters the hole, the cable 16 stops its downward travel and the lance 18 comes to rest. In the preferred embodiment, lance 18 may have positioning means 101 which extend outwardly from the lance 18 so as to securely position the lance 18 in the hole 13. Once this stable position is achieved, various functions begin which are controlled from within the lance 18 by sequencer 54. Of course, it is within the scope of this invention to have controls which extend out of the hole 13 such that the various functions and operations of the lance 18 can be controlled from the surface of the ground. The battery 56 powers the various elements such as the sequencer 54 and the feedback system 58, as well as the fuel pump feed system 30 in order to pump the reactants to the drill bit 52. At a predetermined depth the sequencer activates the toothed wheel 108 and the hydraulic system 42. Wheel 108 begins to rotate and forces the drill bit 52 out of opening 53 located adjacent to end 26. To prevent undesirable material from entering the lance 18, a debris shield may cover opening 53 such that upon abutment thereon by drill bit 52, the shield is flipped into an open position. Of course, during this operation, the fuel pump system 40 has been activated and is pumping the various reactants to the drill bit 52 in order to produce the necessary flame jet.

As indicated in FIGS. 7 and 8, the teeth 109 of the toothed wheel 108 engages the teeth 117 on each of the links 50. Each link member 50 is joined to an associated link 50 by means of joints 115 and is rendered rotatable about axil swivel members 123 which proceed through joints 115. Members 123, which may be bolts, and the like, cause the links 50 to easily bend around the wheel 108. Further flexibility of the links 50 is powered by flexible joint members 115, located on each guide member 112. As each of the links 50 approaches the locking device 60, the movable arm 132 is moved into position such that the slotted engaging member 136 engages the latch 120 and more specifically head member 124. In the preferred embodiment, the arm 132 is then retracted into the motor 130 such that the latch 120 is drawn across to the adjacent link 50. The tab 122 slides along ledge 119 and comes to rest across the joint 115 and engages the adjacent link thus rendering such adjacent link substantially immovable, i.e. two associated members 123 no longer can rotate each link 50.

As the drill bit 52 begins its flame jet action, cross hole 22 lateral to the lance 18 is formed. It should be noted, as indicated in FIG. 2, that while the latch 120 does render two adjacent links 50 substantially immovable, there is some degree of flexibility and thus a bending moment is created so as to permit an arcuous path to be taken by the drill bit 52. In this manner, cross holes 22 are formed. The distance in rate of progress that the drill bit 52 is making through the ground is transmitted back to the lance 18 and specifically to the feedback system 58. Thus, the location of the drill bit 52, as well as the time when burn out occurs, is noted by the feed back system 58 which in turn transfers such information to the sequencer 54 so as to regulate (i) the pumping rate of system 30, (ii) the rate of extension of member 98, and (iii) the direction of travel of member 48. Such feedback systems will not be discussed in detail herein and are well known in the art. Upon burn out, the toothed wheel 108 and the hydraulic system 42 are again activated so as to move in a direction opposite to that direction used to cause the drill bit 52 to extend out of the lance 18 through openings 53. As each link begins to enter back through opening 53 in the top 26 of the lance 18, the locking device 60 is once again activated so as to move the latch 120 into its original position such that it is no longer disposed across two adjacent links. In this manner, each link 50 is permitted to travel around the toothed wheel 108 such that the bending action is taken up by the joint 115. Thus, the entire extension member 48 as well as the drill bit 52 proceed back into the lance 18. Because of this flexible action of the extension member 48, the lance can have a slim profile with no extending members and thus can be used in many preexisting holes even though such hole may have a relatively small diameter. When the drill bit 52 is completely within the lance 18, the rig 10 then raises the lance 18 to the surface where it is exchanged for a new lance. Of course, it is to be understood that rather than exchange the spent lance for a new one, the spent lance can be refilled and lowered again. A second cross hole may then be formed or the first cross hole extended.

In this manner, oil, gas and the like are encouraged to drain through each of the cross holes 22 so as to ultimately enter the originally formed well hole 13. The original pumping system can then be replaced in the well hole 13, which oil and/or gas which previously could not be removed is now rendered easily removable.

Although this invention has been disclosed and described with reference to a particular embodiment, the principles involved are susceptible of other applications which will be apparent to persons skilled in the art. For example, rather than use latch 120, other type of connection means can be used. For example, a flexible, hinged band which is elastic when opened and rigid when closed can be used to join each of the links 50 together. As the links would proceed out of the lance 18, each hinged band would be actuated whereby it would be rendered substantially rigid. As the drill bit 52 was again caused to reenter the lance 18, such bands would then be deactivated rendering them sufficiently flexible so as to cause the entire extension member 48 including the drill bit 52 to once again enter the lance 18.

As with the latch 120, other types of driving means other than wheel 108 and hydraulic system 42 may also be used to drive the extension member 48 out of the lance 18. For example, a mechanical system utilizing the rack and pinion gear principle could be used to push or pull the extension member 48 out of the lance 18 wherein the extension member 48 would use a guide system so as to guide the extension member 48 along a desired path. In the present invention, guide members 112 and 114 are used to guide the extension member 48 around the wheel 108 and out of the lance 118. Such a guide system could also be used in combination within the mechanical system. Finally, a wide range of oxidizers and fuels such as nitrogen tetroxide, other nitrogen-oxygen compounds, oxygen and the like are within the scope of this invention. The specific reactants depend upon the desired thermal energy which, in turn, depends upon the kind of rack formations which are present. This invention, therefore, is not intended to be limited to the particular embodiment herein disclosed.

We claim:

1. A flame jet tool forming cross holes in the ground comprising an elongated tube-like member, a fuel system disposed within said tube-like member, and an extension member comprised of a series of interconnected link members and having a first and second end with said first end being coupled to a drill bit, and said second end being coupled to said fuel system, said extension member being movable from a position within said tube-like member to an extended position lateral to said tube-like member.

2. A flame jet tool according to claim 1 wherein said fuel system comprises a series of tanks with each said tank disposed one atop the other.

3. A flame jet tool according to claim 1 wherein, in addition thereto, driving means for moving said extension member is disposed in said tube-like member.

4. A flame jet tool according to claim 3 wherein said driving means for moving said tube-like member comprises a toothed wheel, said toothed wheel engaging said extension member.

5. A flame jet tool according to claim 1 wherein each of said series of interconnected link members includes an associated series of latch members coupled thereto, said latch members, when moved into a predetermined locked position, selectively rendering two adjacent link members substantially rigid.

6. A flame jet tool according to claim 5 wherein each said latch member is selectively moved into said predetermined locked position by a locking means.

7. A flame jet tool according to claim 5 wherein each said latch member has a tab member which is slideably disposed in an associated link member.

8. A flame jet tool for forming cross holes in the ground comprising:

a. an elongated tube-like member having a first and second end;

b. a series of interconnected fuel tanks disposed within said tube-like member;

c. an extension member, said extension member coupled to said fuel tanks at one end thereof and having a rotatable drill bit disposed at the other end thereof, said extension member consisting of a series of interconnected links, said links having a series of latch members coupled thereto;

d. driving means for moving said extension member from a position within said tube-like member to an exterior position lateral to said tube-like member, said driving means disposed in said elongated tube-like member adjacent said first end thereof; and e. locking means for activating said series of latch members such that said links are selectively rendered substantially rigid when said extension member is moved into said exterior position.

9. A flame jet tool according to claim 8 wherein said locking means is a device having an arm member for selectively engaging each of said latch members.

10. A flame jet tool according to claim 8 wherein each said link has at least one tooth-like segment which is selectively engageable by said driving means.

11. A flame jet tool according to claim 8 wherein each said latch member has a tab member which is slidably disposed in an associated link member.

12. In a drilling system for forming holes in the ground, a drilling rig, a flame jet lance coupled to said rig such that said lance can be raised and lowered, and an extension member comprised of a series of interconnected links, said links having guide members for guiding said links in said lance, said extension member disposed in said lance having a drill bit at one end thereof and being movable from an initial position within said lance to an extended position outside of and lateral to said lance.

13. A drilling system according to claim 12 wherein each said link has a latch member coupled thereto, said latch member being movable from a first position wherein adjacent links are flexible, to a second position wherein adjacent links are rendered substantially rigid.

14. A drilling system according to claim 13 wherein said latch member has a tab member which is slidably disposed in an associated link.

15. A drilling system according to claim 13 wherein locking means is disposed in said lance, said locking means for selectively moving each said latch member from said first position to said second position so as to fixedly join adjacent links as said extension member is moved out of said lance.

16. A drilling system according to claim 12 wherein said flame jet lance includes a series of interconnected tanks for supplying fuel to said drill bit.

17. A drilling system according to claim 16 wherein at least one of said tanks contains an oxidizer and another tank contains a combustible fuel.

18. A flame jet tool for forming cross holes in the ground comprising an elongated tube-like manner, a fuel system disposed within said tube-like member, and an extension member comprised of a series of interconnected link members and having a first and second end with said first end being coupled to a drill bit, containing a rotatable nozzle member, and said second end being coupled to said fuel system, said extension member being movable from a position within said tube-like member to an extended position lateral to said tube-like member.

19. A flame jet tool according to claim 18 wherein in addition thereto, driving means for moving said extension member is disposed in said tube-like member.

20. A flame jet tool according to claim 18 wherein said fuel system comprises a series of interconnected tanks.

21. A flame jet tool according to claim 18 wherein at least one of said tanks contains an oxidizer and another tank contains a combustible fuel.

22. A flame jet tool according to claim 18 wherein each of said series of interconnected link members includes an associated series of latch members coupled thereto, said latch members, when moved into a predetermined locked position, selectively rendering two adjacent link members substantially rigid.

23. A flame jet tool according to claim 22 wherein each said latch member is selectively moved into said predetermined locked position by a locking means.

24. In a drilling system for forming holes in the ground, a drilling rig, a flame jet lance coupled to said rig such that said lance can be raised and lowered, and an extension member disposed in said lance having a drill bit at one end thereof and being movable from an initial position within said lance to an extended position outside of and lateral to said lance, and wherein driving means for moving said extension member is coupled to said extension member in said lance.

25. In a drilling system for forming holes in the ground, a drilling rig, a flame jet lance coupled to said rig such that said lance can be raised and lowered, and an extension member disposed in said lance having a drill bit at one end thereof and being movable from an initial position within said lance to an extended position outside of and lateral to said lance, and wherein fuel tanks are disposed in said lance and are coupled to said drill bit by flexible tubing, said tubing traveling through a cavity in said extension member.

* * * * *